US006302750B1

(12) United States Patent
Foreman

(10) Patent No.: US 6,302,750 B1
(45) Date of Patent: Oct. 16, 2001

(54) MARINE MOTOR DRIVE ASSEMBLY

(76) Inventor: Glenn D. Foreman, 9358 Springwood La., Sandy, UT (US) 84094

( * ) Notice: Subject to any disclaimer, the term of this patent is extended or adjusted under 35 U.S.C. 154(b) by 0 days.

(21) Appl. No.: 09/599,904

(22) Filed: Jun. 23, 2000

Related U.S. Application Data

(60) Provisional application No. 60/161,513, filed on Oct. 12, 1999.

(51) Int. Cl.[7] ..... B63B 3/00
(52) U.S. Cl. ..... 440/83; 440/112; 277/336
(58) Field of Search ..... 440/82, 83, 112; 277/336

(56) References Cited

U.S. PATENT DOCUMENTS 4,936,593 * 6/1990 Finney ..... 440/112
5,195,754 * 3/1993 Dietle ..... 277/336
5,310,372 * 5/1994 Tibbets ..... 440/112

* cited by examiner

*Primary Examiner*—Jesus D. Sotelo
(74) *Attorney, Agent, or Firm*—Thorpe North & Western LLP

(57) ABSTRACT

A roller bearing drive assembly for a marine mud motor with an elongated drive tube containing a lubricant and for rotatably receiving a drive shaft including a propeller on the end. The drive assembly comprises a drive assembly housing having an upper end, lower end, and housing cavity. An outer seal is mounted in the lower end of the drive assembly housing and structured to stop lubricant flow from the housing cavity. A seal cap is mounted to protect the outer seal from the elements. An inner seal is provided, between the outer seal and the upper end of the drive assembly housing, and spaced apart from the outer seal to provide a lubricant chamber for pressurized lubricant. The pressurized lubricant in the lubricant chamber cannot escape because the two seals are installed in opposing directions allowing pressurized fluid to enter but not escape the lubricant chamber. A needle, ball or roller bearing above the inner and outer seals along with a grease reservoir that produces head pressure produces the lubricant pressure. The developed pressure reverses the normal tendency of the drive to create a Venturi effect that attempts to draw water inside the drive tube past seals into the drive tube which leads to increase wear, corrosion, and early failure. This pressurized lubricant also creates a secondary barrier that enhances the sealing capability of the seals and significantly extends the life of the drive.

20 Claims, 3 Drawing Sheets

MARINE MOTOR DRIVE ASSEMBLY

This application claims priority to U.S. Provisional Application No. 60/161,513 filed Oct. 12, 1999.

TECHNICAL FIELD

The present invention relates generally to a marine motor drive assembly, particularly useful as part of the drive shaft mechanism in a marsh motor on a shallow water boat.

BACKGROUND

A marine mud motor is a specialized marine motor used to propel a boat in shallow water applications. These motors are useful in marshes or other shallow water areas where the propeller frequently comes in contact with rocks, mud, logs, and weeds, etc., at the bottom of the body of water. The design of the motor and drive shaft propels boats in extreme conditions by allowing the propeller to ride gently over these obstacles with minimal damage to the drive.

A marine mud motor, illustrated in FIG. 1, includes a frame 8 that supports an engine 14. The frame is mounted on a boat 10 by an engine mount 30. A long drive tube 16 is coupled to the frame by supports 28 and the drive tube contains a drive shaft 26. A propeller 22 is connected to the drive shaft and moves a boat forward. This design has been used for more than 30 years and is in use throughout the U.S. and Asia today to propel boats through adverse shallow water conditions.

The conventional design described above has a long drive tube 16 that encases a drive shaft 26 which is three to seven feet in length. This design includes a drive shaft, which is supported during rotation by bronze or composite bushings pressed into the drive tube, one on the bottom end and one on the top end of the drive tube. The bushings are contained in the drive tube assembly 16. Marine mud motors using bronze or composite bushings pressed into the drive tube have been in production around the world for over 30 years.

As with any device operated under water, moisture is a serious problem. Seals are used to keep water out and lubricants inside the drive. Because bronze and composite bushings do not corrode easily, they have conventionally been used as a wear surface in the drive. Roller bearings have been tried, but have repeatedly failed due to corrosion and alignment difficulties associated with this conventional design. The use of roller bearings has failed due to the extreme conditions in which the motors are used, and the eventual intrusion of water, dirt and sand, which quickly rusts and seizes the bearing, leading to extremely early failure.

To avoid this early drive shaft failure, multiple seals conventionally are used and the drive tube is filled completely with grease. Even with multiple seals and filling the tube with grease, water, dirt, and particles enter the drive and cause early bearing failure. This early bearing failure usually takes less than two years, even with constant attention and lubrication. For example, users must frequently fill the drive tube with grease, which tends to leak out.

Another significant problem is due to the drives' inherent design. The rotating shaft causes a Venturi effect which draws water up inside the drive tube past the multiple seals. Because the drive is in frequent contact with the bottom of the body of water, silt and sand accompany the water, which is pulled into the drive tube. Of course, the silt, particles and sand significantly accelerate bushing and drive tube wear and induce early failure.

Even more water and silt is pulled into the drive tube when the drive is at rest in the water. This is caused by cooling parts that create a vacuum, which draws water inside the drive. This additional water, silt and sand further contribute to the problem of the Venturi effect.

Because of these problems, bronze bushings, composites and even ceramics have been used as a wear surface for the rotating drive shaft. Other bearings have been tried, but the sand, dirt and water wear them out in a very short time. Accordingly, the use of bronze or composite bushings in the drive tube has been the industry standard.

Conventional drive tubes are completely, or nearly completely, filled with grease which lubricates both the top and bottom drive bushings. This lubrication helps combat any moisture that enters the system and helps to hydraulically balance the long drive shaft, which tends to vibrate during operation due to its length. Seals mounted on each end of the drive tube keep the grease inside the tube. The lower end of the drive tube supports the propeller and commonly features multiple seals, usually three. One of the seals is used to keep the grease inside the drive tube and two of the three seals are reversed, thus keeping water from entering the drive tube. Multiple seals are used because the long drive tube causes a Venturi effect, which attempts to draw water inside the drive tube. The two reversed seals slow this "pumping" process down. Regardless, the Venturi effect is strong and eventually small amounts of water with silt enter the system and cause accelerated wear and contamination of the lubricant. For this reason, bearings have not been used successfully because the moisture and dirt causes early bearing failure. Thus, only bushings have been used for the past 30-plus years.

SUMMARY OF THE INVENTION

It has been recognized that it would be advantageous to develop a system which would allow bearings to be used in a marine motor drive shaft. In addition, it would be valuable to have a device which can overcome the Venturi effect and stop the flow of water, silt and sand into a drive shaft.

The present invention provides a drive assembly for a marine mud motor with an elongated drive tube containing a lubricant. The drive tube rotatably receives a drive shaft including a propeller on the drive shaft end. The drive assembly comprises a drive assembly housing having an upper end, lower end, and housing cavity. An outer seal is mounted in the lower end of the drive assembly housing and structured to stop lubricant flow from the housing cavity. An inner seal is provided, between the outer seal and the upper end of the drive assembly housing, and spaced apart from the outer seal to provide an area for pressurized lubricant.

In accordance with one aspect of the present invention, the system includes a drive assembly containing a roller bearing and a structured seal arrangement. The roller bearing drive assembly provides a drive rotation pressure which overcomes the system's inherent Venturi effect by first reversing the Venturi effect, and then creating a pressurized lubricant chamber. The drive assembly contains a bearing set and two or more seals. Two seals can develop the desired results, although more than one bearing or two seals may be used. Hydraulic pressure is generated on the lower end of the bearing due to its accelerated rotation and slope. This pressure is used to force lubrication or grease past the lip of the innermost seal, which is installed in a reverse direction. The grease then flows under pressure into a chamber between the inner and outer seals. The pressurized lubricant in the lubricant chamber cannot escape because the two seals are installed in opposite directions, allowing pressurized lubricant to enter from the bearing side but not escape the area between the two seals. The developed pressure reverses the normal tendency of the drive to create a Venturi effect that attempts to draw water inside the drive tube past seals into the drive tube which leads to increased wear, corrosion, and early failure. Alone, this pressure helps keep water out of the system, but when captured in a seal assembly, a secondary barrier is provided that maximizes its sealing capability, thus extending the life of the drive. This configuration allows the use of roller bearings in mud motors that could not use roller bearings as a wear surface due to water contamination. The use of an integral assembly having a removable housing, containing a bearing, seals, and seal cap benefits this application.

Additional features and advantages of the invention will be set forth in the detailed description which follows, taken in conjunction with the accompanying drawings, which together illustrate by way of example, the features of the invention.

DETAILED DESCRIPTION

Figure 1:
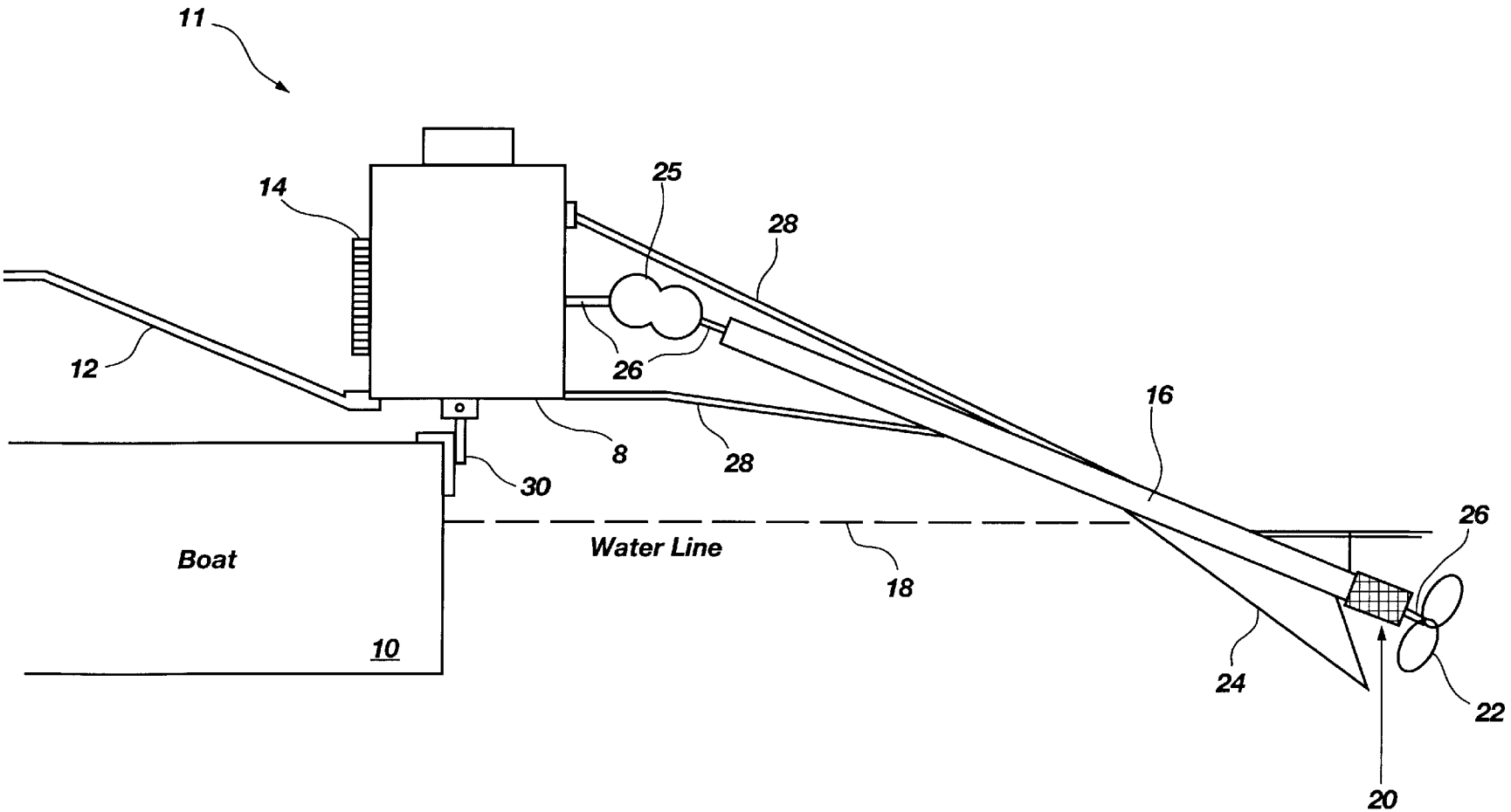
FIG. 1 is a side view of a marine mud motor mounted on a boat.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As illustrated in FIG. 1, a marine mud motor system 11 is shown for propelling a boat 10 through shallow water 18. These types of motors are used in marshes and swampy areas. In accordance with one aspect of the present device, the marine mud motor system includes a frame 8 that supports the engine 14. The frame is mounted on the boat by an engine mount 30. The marine mud motor system includes a roller bearing drive assembly 20 for a marine mud motor with an elongated drive tube 16 containing a lubricant. In addition, the drive tube rotatably receives a drive shaft 26 through the drive tube. The motor drives the drive shaft via a universal joint 25. The long drive tube is coupled to the frame by supports 28, and includes a rudder fin 24 that is directionally controlled by the operator handle 12. A propeller 22 is coupled onto the end of the drive shaft to move the boat forward.

Figure 2:
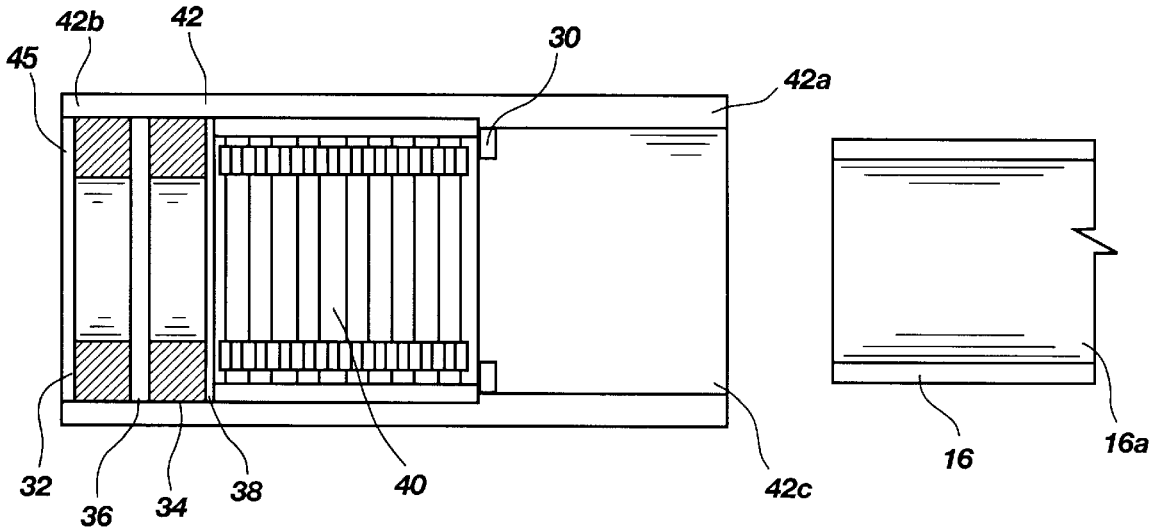
FIG. 2 is a lengthwise cross-sectional side view of the roller bearing drive assembly housing without the drive shaft.

The roller bearing drive assembly, as depicted in FIG. 2, comprises a drive assembly housing 42 having an upper end 42*a,* lower end 42*b,* and a housing cavity 42*c*. The roller bearing drive assembly housing operates below the water line. A roller bearing 40 is mounted inside the drive assembly. An outer seal 32 is mounted into the lower end of the drive assembly housing. The outer seal is oriented to stop lubricant flow from the housing cavity and to resist water entering the cavity. An inner seal 34 is located between the outer seal and the roller bearing drive assembly housing, and is spaced apart from the outer seal to provide an area for pressurized lubricant 36. A seal 45 cap is mounted on the lower end of the roller bearing drive assembly to keep seals inside the housing and to protect the seals from outside elements.

More specifically, the space between the outer seal 32 and inner seal 34 forms a lubricant chamber 36 between the inner seal and outer seal. The lubricant chamber is pressurized by lubricant flowing past the inner seal. A one-way seal is used for the inner seal because it only allows the lubricant to flow past it in one direction. Bearing rotation causes the lubricant to press past the innermost seal in the lubricant chamber. After the lubricant has passed the inner seal, it is trapped between the outer seal and inner seal, creating pressure which builds up during operation. The pressurized lubricant chamber provides a significant improvement over conventional designs in that it acts as a barrier to keep water and particles out of the drive assembly housing.

Conventionally, a single seal is placed in the drive shaft to keep grease from leaking outside the enclosed system. Sometimes multiple seals facing the same direction will be used. The seal is designed to keep water from passing by the rubber lip of the seal in one direction. Regardless, the Venturi effect is strong and eventually small amounts of water with silt enter the system and cause accelerated wear and contamination of the lubricant. The contamination also breaks down the seals and allows lubricant to escape from the drive tube.

The preferred configuration of the present device places two seals back-to-back in opposite directions, or opposing one-way flow directions. A back-to back configuration allows the pressurized grease inside the drive tube to be forced past the inner reversed seal and into the lubricant chamber between two seals. Since the outer seal is placed into the drive in a conventional direction, the lubrication or grease cannot pass by this seal to the outside of the drive. Thus, the orientation and arrangement of the seals builds a pressurized lubricant chamber between two seals.

Two seals placed in opposite directions are used to form a chamber where lubrication or grease, when forced by pressure past the inner seal, is used to create a pressurized chamber that remains pressurized when the drive is rotating or at rest. This pressurized chamber provides a superior barrier that prevents water from entering the drive tube when running. When the system is not operating and is at rest, it cools but remains pressurized and keeps water and silt from being drawn past the seal configuration and into the drive due to the vacuum caused by the cooling and shrinking of parts within the drive tube. In the prior art, water has a tendency to be drawn into the drive assembly housing 42 when the drive is operated or when it cools. This leads to accelerated deterioration of seals and drive parts, and early failure.

Figure 5:
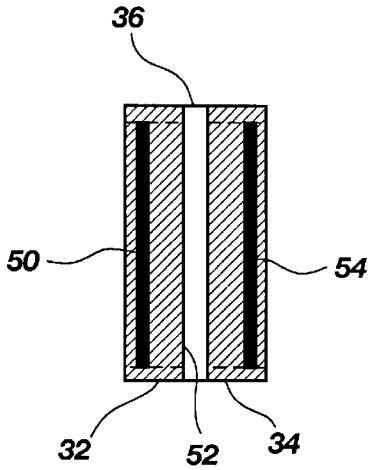
FIG. 5 is a side view of an inner and outer seal showing the lips on the seals in accordance with the present invention.

Referring now to FIG. 5, a side view of the seals is shown. In the preferred embodiment, the outer seal 32 can have a double lip, or outside and inner lips 50 and 52. The outside lip 50 facing the water and propeller prevents mud, silt and matter from reaching the inner lip of the seal 52. The inner lip of the seal then performs longer by keeping grease in the pressurized chamber 36 between the two seals. The outer seal 32 can have a vulcanized rubber surface and a stainless steel inner-spring (not shown) that maintains the seal lip pressure on the drive shaft, thus helping to prevent leakage. Other configurations which perform the same functionality can also be used. This seal is especially made to perform in water, to seal out matter, and protect the inner seal that keeps lubricants or grease in the pressurized chamber. The seal is lubricated by water on the outside edge and grease on the inside.

The inner seal 34 has a single lip 54 designed to prevent fluids such as grease from passing back into the roller bearing area of the drive assembly. The single lip seal does allow grease from the drive assembly to pass by the seal lip into the lubricant chamber between the inner seal and outer seal 32. The inner seal can be vulcanized and its inner spring can be stainless steel (not shown) to prevent corrosion, and the inner seal is lubricated by grease on both sides.

Figure 4:
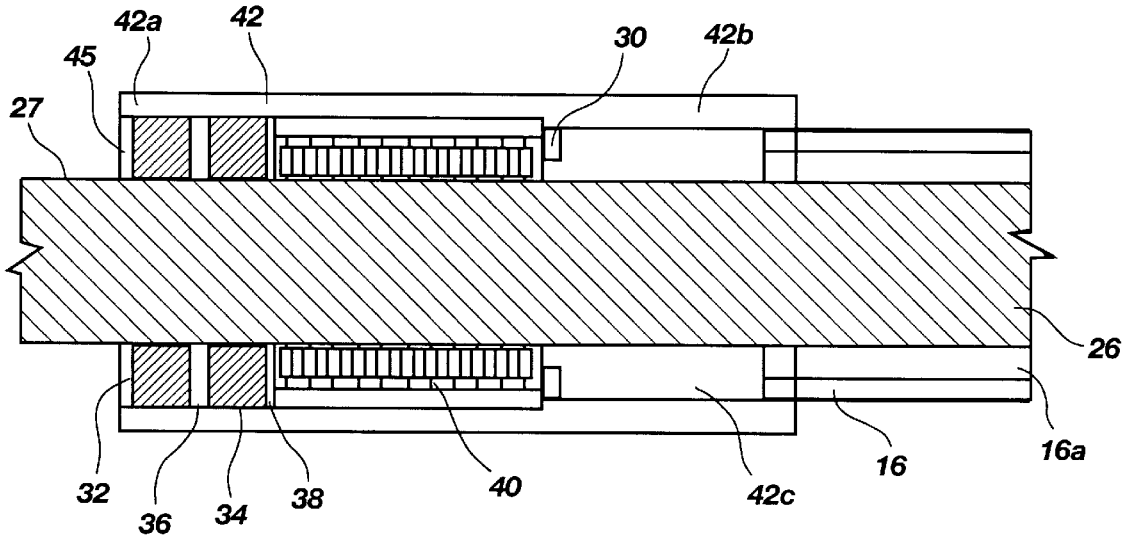
FIG. 4 is a lengthwise cross-sectional side view of the drive assembly housing, containing a roller bearing, seals, seal cap and a drive shaft.

As illustrated in FIGS. 2 and 4, a bearing 40 is located in the drive assembly housing 42. This bearing is located forward of the outer seal 32 and inner seal 34. The drive assembly housing 16A and roller assembly housing 42C are filled with a lubricant and forms a type of lubricant reservoir. This lubricant may be a grease, thick oil or other lubricant well known to those in the art for drive shaft lubrication. Preferably, the grease used is a marine grade grease which is filled to a level above the roller bearing to create head pressure that allows the spinning roller bearing in the drive assembly to build pressure on the lower end of the roller bearing. Hydraulic pressure is generated on the lower end of the bearing due to its accelerated rotation and slope. This pressure is used to force lubrication or grease past the lip of the innermost seal, which is installed in a reverse direction as compared to the prior art. The bearing pressure also circulates the lubrication through the drive shaft which significantly reduces the amount of maintenance required by a user.

The bearing 40 can be a roller bearing, a ball bearing or an equivalent bearing or bearings used by those skilled in the art. The preferred bearing is a needle or roller bearing or one or more ball bearings. Previously a roller bearing has not been used because it would wear out too quickly as a result of water, dirt, sand, silt and other particles entering the drive shaft. Also, because a bearing requires near perfect alignment to operate, the prior art did not use roller bearings incorporating machined parts that are assembled in one unit to provide use of the roller bearing while protecting its life through the use of a seal mechanism that maintains a pressure chamber to protect the bearings from water, silt and other contaminants. Another major advantage of the use of a roller bearing is that its wear surface for the drive out-lasts and out-performs bushings and composites.

The configuration of a roller bearing and structured seals reverses the Venturi problem in the drive shaft which has not been solved for decades. Water is no longer drawn in through the drive assembly housing and through the drive tube because of the pressure provided by the roller bearing. To provide added benefit, this pressure buildup is used in conjunction with a seal assembly design to build a pressurized chamber, which provides additional protection for the bearing by preventing water from entering the system during operation. The seal set is pressurized within the first 5 to 10 minutes of operation and maintains a set pressure for the life of the seals. Every time the system is run it continues to re-pressurize the area between the two seals protecting the bearing from moisture. This protective arrangement increases the ease of maintenance for the marine mud motor.

An additional advantage is provided because the pressurized lubricant chamber maintains its pressure when the engine is not running and prevents water from being drawn into the drive tube caused by retraction of cooling parts.

The lubricant chamber can also be pressurized using some other pressurization member for pressurizing the area between the first and inner seals with lubricant. For example, a direct conduit can be directed into the pressurization chamber which would allow pressurized grease to be pumped or fed via a spring loaded assembly into the lubricant chamber between the two seals. Alternatively, an impeller in the drive tube can produce pressure within the lubricant.

When using a roller bearing to pressurize the lubricant chamber 36, it is advantageous to have an area 38 for the roller bearing to build lubricant pressure so the lubricant is forced past the inner seal. Accordingly, a pressurization gap can be used between the inner seal and the roller bearing to pressurize lubricant from the roller bearing which passes by the inner seal. For example, a gap greater than 1/16 of an inch may be used to allow lubricant pressure to build up from the bearing. Referring to FIG. 4, the roller bearing assembly is attached to the drive tube 16 on the outside or inside of the drive tube. Outside attachment is preferable to allow circulation of the lubricant within the drive tube, extending maintenance intervals. The roller bearing assembly also can be attached inside the drive tube. Furthermore, the roller bearing drive assembly contains a seal cap 45 which protects the outer seal 32 from debris and wear. The cap can be pressed into the unit, screwed, glued or welded onto the lower end of the unit.

Figure 3:
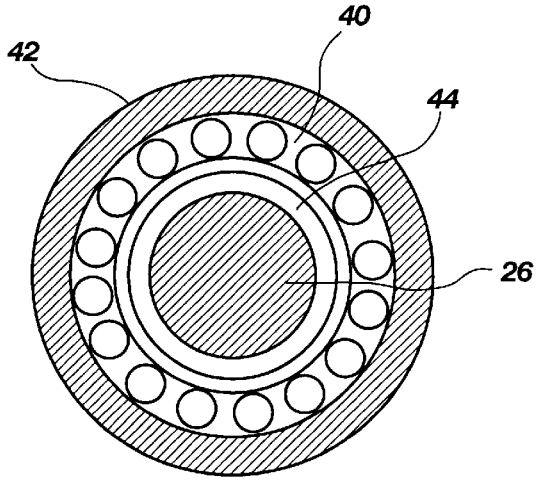
FIG. 3 is a cross-sectional end view of the drive assembly housing.

Referring now to FIG. 3, a cross sectional view of the roller bearing and drive assembly housing are shown. A drive shaft 26 is coupled to the roller bearing sleeve 44 and the roller bearing 40 allows the drive shaft to spin within the drive assembly housing 42 and drive the propeller. The drive assembly housing is made from machined stainless steel to reduce corrosion. The machined inner bore is designed to contain the pressed-in bearing assembly and two seals. More seals can be used if desired. The opposite end of the inner bore is designed to be pressed on, or into the drive tube. The drive assembly housing also can be screwed, glued, or welded into or over the drive tube. The assembly housing also can be made as a permanent fixture of the drive tube.

FIG. 4 depicts the drive shaft 26 running through the drive assembly housing 42 and drive tube 16. The cavity formed in the drive assembly housing and drive tube contains a lubricant such as grease. As mentioned, the drive shaft passes through the roller bearing 40, outer seal 32 and the inner seal 34 to form a pressurized lubricant chamber 35 which is located between the seals and surrounds the drive shaft. A propeller is connected at a lower end 27 of the drive shaft.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A drive assembly for a marine mud motor with an elongated drive tube for rotatably receiving a drive shaft therethrough and containing a lubricant, including a propeller on the end of the drive shaft, the drive assembly comprising:

(a) a drive assembly housing having an upper end, lower end, and housing cavity;

(b) an outer seal, mounted into the lower end of the drive assembly housing, oriented to stop lubricant flow from the housing cavity;

(c) an inner seal, between the outer seal and the upper end of the drive assembly housing; and (d) an area, formed between the inner and outer seals, configured to contain pressurized lubricant.

2. A drive assembly in accordance with claim 1, further comprising a pressurization member for pressurizing the area between the outer and inner seals with lubricant.

3. A drive assembly in accordance with claim 2, wherein the pressurization member is a roller bearing located in the drive assembly above the inner seal.

4. A drive assembly in accordance with claim 3, further comprising a pressurization gap formed between the roller bearing and the inner seal, wherein the pressurized lubricant generated by the roller bearing is forced between the outer and inner seal.

5. A device in accordance with claim 1, further comprising a lubricant chamber between the inner seal and outer seal, wherein the lubricant chamber is pressurized by lubricant captured after flowing past the inner seal.

6. A device in accordance with claim 5, wherein the outer seal and inner seal are one-way seals positioned in opposing flow directions.

7. A drive assembly for a marine mud motor, comprising:

a) a drive assembly housing having an upper end, lower end, and housing cavity;

b) a bearing, disposed in the drive assembly housing;

c) an outer seal, mounted into the lower end of the drive assembly housing, oriented to stop lubricant flow from the housing cavity; and d) an inner seal, between the outer seal and the bearing, spaced apart from the outer seal, wherein the inner seal is oriented to allow lubricant to flow away from the bearing and between the inner and outer seal.

8. A device in accordance with claim 7, further comprising a seal cap mounted on the outside of the outer seal to retain and protect the outer seal from water and silt.

9. A device in accordance with claim 7, further comprising a lubricant chamber between the inner seal and outer seal, wherein the lubricant chamber is pressurized by lubricant flowing past the inner seal.

10. A device in accordance with claim 7, further comprising a pressurization gap between the inner seal and the bearing to pressurize lubricant from the bearing to pass by the inner seal.

11. A device in accordance with claim 10, further comprising, a drive shaft passing through the bearing, outer seal and inner seal; and a drive tube, connected to the upper end of the drive assembly housing, wherein the drive tube houses a portion of the drive shaft and contains lubricant.

12. A device in accordance with claim 11, wherein outer and inner seals are both one way seals, directionally flow oriented to capture pressurized lubricant between the seals.

13. A device in accordance with claim 7, wherein the bearing is selected from the group consisting of a roller bearing, needle bearing, and a bearing with ball bearings.

14. A drive assembly for a marine mud motor, comprising:

a) a drive assembly housing having an upper end, lower end, and housing cavity; and b) a roller bearing, disposed in the drive assembly housing;

c) a first one-way seal, mounted into the lower end of the drive assembly housing, oriented to stop lubricant flow from the housing cavity; and d) a second one-way seal, between the outer seal and the roller bearing, oriented to allow lubricant to flow away from the roller bearing;

e) a lubricant chamber between the outer seal and inner seal, wherein the lubricant chamber is pressurized by lubricant flowing past the inner seal and the seals prevent lubricant from leaving the chamber during operation periods; and f) a pressurization gap, between the inner seal and the roller bearing, configured to provide a lubricant pressurization area for the roller bearing, wherein the pressurized grease can pass by the inner seal.

15. A device in accordance with claim 14, further comprising a drive shaft passing through the bearing, outer seal, inner seal and a seal cap, wherein the drive shaft is configured to drive a propeller.

16. A device in accordance with claim 14, further comprising a drive tube coupled to the drive assembly housing, wherein the drive tube houses the drive shaft.

17. A method for keeping particles and water out of an assembly housing of a marine mud motor, the assembly housing having an upper and lower end, the method comprising the steps of:

a) providing a bearing in the assembly housing;

b) preventing lubricant from flowing out of the assembly housing by orienting an outer one-way seal in the lower end of the assembly housing;

c) allowing lubricant to flow into a chamber between a one-way inner seal and the outer seal by orienting the inner seal to allow lubricant to flow away from the bearing;

d) pressurizing the chamber between the outer and inner one-way seals to restrict water and particles from entering the drive assembly.

18. A method in accordance with claim 17, further comprising the step of pressurizing a gap between the inner one-way seal and the bearing, by rotating the bearing to pressurize lubricant in the gap which is then forced into the chamber.

19. A method in accordance with claim 17, further comprising the step of, providing a bearing in the drive assembly which is a roller bearing; and pressurizing lubricant with the roller bearing to force the lubricant through the gap and into the chamber.

20. A method in accordance with claim 17, further comprising the steps of, mounting a drive shaft through the roller bearing, outer one-way seal, and inner one-way seal in order to drive a propeller; and coupling the assembly housing to a drive tube which houses the drive shaft and contains lubricant.

* * * * *